US009758283B2

(12) United States Patent
Prost

(10) Patent No.: US 9,758,283 B2
(45) Date of Patent: Sep. 12, 2017

(54) MEASURING CAP

(71) Applicants: Euromoule, Chevannes (FR); Doucet, Paris (FR)

(72) Inventor: Frederic M Prost, Paris (FR)

(73) Assignees: EUROMOULE, Chevannes (FR); DOUCET, Paris (FR)

( * ) Notice: Subject to any disclaimer, the term of this patent is extended or adjusted under 35 U.S.C. 154(b) by 0 days.

(21) Appl. No.: 15/026,345

(22) PCT Filed: Sep. 3, 2014

(86) PCT No.: PCT/FR2014/052175

§ 371 (c)(1),
(2) Date: Mar. 31, 2016

(87) PCT Pub. No.: WO2015/049429

PCT Pub. Date: Apr. 9, 2015

(65) Prior Publication Data

US 2016/0214773 A1 Jul. 28, 2016

(30) Foreign Application Priority Data

Oct. 3, 2013 (FR) ..... 13 59590

(51) Int. Cl.
*B65D 51/28* (2006.01)

(52) U.S. Cl.
CPC ..... *B65D 51/2842* (2013.01)

(58) Field of Classification Search
CPC .. B65D 51/22; B65D 51/226; B65D 51/2842; B65D 51/2814; B65D 51/2807; B65D 5/748; B65D 5/747; B65D 39/16; F16K 13/04; F16K 17/1626; F16K 17/16; F16K 17/40; F16K 17/403
USPC ..... 215/227, 297, 296, 295; 220/212, 278, 220/277, 267, 266, 265; 222/145.6, 222/145.5, 145.4, 145.1; 137/68.3, 68.29, 137/68.19
See application file for complete search history.

(56) References Cited

U.S. PATENT DOCUMENTS 4,195,730 A * 4/1980 Hunt ..... B65D 51/2814 206/221
5,246,142 A * 9/1993 DiPalma ..... B65D 25/087 206/219
2005/0126632 A1* 6/2005 Farrell ..... B65D 51/2814 137/155

(Continued)

FOREIGN PATENT DOCUMENTS

DE 102004013270 A1 9/2005

*Primary Examiner* — Robert J Hicks
(74) *Attorney, Agent, or Firm* — Bachman & LaPointe, P.C.

(57) ABSTRACT

A cap made up of a body defining an interior volume for receiving a liquid or powdered or pasty composition intended to be transferred into a container having a threaded neck, the cap having a skirt provided with a thread matching the thread of the neck of the container, and a membrane connected to the inner wall of the body by a generally annular peripheral zone, wherein it has a break-off line situated between the peripheral zone and the membrane, such annular peripheral zone being so configured as to bear on the upper surface of the neck of the bottle during screwing of the skirt onto the threaded neck of the container and to cause at least a partial rupture of the break-off line.

10 Claims, 11 Drawing Sheets

(56) References Cited

U.S. PATENT DOCUMENTS

| | | | | |
|---|---|---|---|---|
| 2007/0079895 | A1 | 4/2007 | Jeng | |
| 2007/0289663 | A1* | 12/2007 | Johns | B65D 51/2814 141/112 |
| 2008/0142471 | A1 | 6/2008 | Yorita | |
| 2008/0289976 | A1* | 11/2008 | Henry | B65D 81/3211 206/222 |
| 2010/0200536 | A1* | 8/2010 | Van den Broek | B65D 51/2835 215/316 |
| 2010/0301002 | A1 | 12/2010 | Deperrois et al. | |
| 2011/0049081 | A1* | 3/2011 | Bourguignon | B65D 51/28 215/227 |

* cited by examiner

MEASURING CAP

BACKGROUND

The present invention relates to the field of caps intended to be connected to the threaded neck of a bottle or a container, in order to transfer a liquid, pasty or powdered additive, for example an organoleptic supplement, a mineral, a colouring agent, a taste additive or a chemical supplement, for example a catalyst, a reagent or a detergent, into the contents of the bottle or of the container. The contents of the measuring cap is intended to be mixed with the contents of the container or of the bottle whereon it is placed, or to recharge the container.

To allow an easy use of such measuring caps, they must reduce handling and ensure a perfect sealing both during the phase of positioning on the container and during the phase of transfer of the dose contained in the measuring cap.

Various solutions for the production of such devices, are known in the prior art especially for the production of measuring caps.

The German Patent DE102004013270 is known in the prior art, which describes a fitting to be screwed onto the neck of a bottle and provided with a membrane. This membrane is connected to the inner annular surface of the fitting by an annular zone having a reduced thickness. When the fitting is screwed onto the bottle neck, the front zone of the neck comes into contact with the membrane and not with the annular peripheral area having a reduced thickness and exerts an axial force causing the tearing of this annular area in an uncontrolled manner up to the tearing thereof. The membrane is then released and the neck goes into the fitting.

This solution provides for the sealing at the bottom of the thread which is not adapted to hold the contents of the fitting during the various handlings of the system.

The US patent application US2010/301002 is also known in the prior art, which describes a measuring cap for a product to be added to a liquid contained in a container with a neck adapted to receive a screwed cap comprising:

- a first crown-cap-shaped part having a bottom and a lateral skirt, the end opposite the bottom of which is provided with an inner thread
- a second cup-shaped part with a bottom and a side skirt.

The cup and the crown-cap have first snapping means which cooperate to hold the cup in the membrane in a first relative axial position with a sealed peripheral contact therebetween.

A spacer extending inside the cup skirt from the bottom thereof towards the bottom of the crown-cap to form a stop limiting the sinking of the cup into the crown-cap beyond the first position. This spacer is a means for breaking the bottom of the cup when the insertion of the latter into the crown-cap is forced beyond said first position by the sealing surface of the neck.

This solution raises sealing problems due to the sliding of the crown-cap relative to the cup.

Furthermore, the spacer occupies the useful volume and therefore reduces the capacity of the measuring cap. It can also deform upon screwing, and thus not efficiently execute its punching part.

Also known is the document US2008/142471 which describes another example of a measuring cap.

The patent application US2007/079895 discloses another exemplary bottle comprising a water tank, a threaded neck and an upper tank. The upper tank has an upper part, a lower part removably attached to the upper part, a cylindrical coupling element protruding downwards from the lower part and comprising inner threads fixed to the neck, and a sealing gasket formed in an upper part of the coupling element and above the opening. In the alternative solution shown in FIGS. 5 and 6 in this document, a hollow element punches a membrane, when the user presses the top of the upper elastomer tank.

Many of the prior art solutions provide for a finger positioned in the interior volume of the measuring device, exerting a stress on a membrane when screwing the measuring device onto the container neck.

These solutions have several drawbacks. First, the volume of the finger reduces the useful volume, and requires to increase the overall size of the measuring device to compensate for the dead volume occupied by the finger.

Secondly, the production by plastic molding is complicated by this finger erected on the surface of the cap bottom.

Other solutions provide for a membrane surrounded by a break-off line torn when the measuring device engages onto the neck of the bottle and upon screwing.

These solutions are not satisfactory either, because the membrane is released after breaking, and may penetrate into the bottle, or move into a position where it becomes an obstacle in the flow of the contents of the measuring device into the bottle, besides sealing is no longer ensured at the sealing surface or at the top of the bottle ring, which results in a loss of the contents of the fitting during the various handlings of the system.

Moreover, the solutions of the prior art have complex configurations requiring either the assembling of several parts, or an industrial production with complex molding tools, including sliding molds.

Eventually, in most solutions of the prior art, the devices have different parts in relative motion, which makes it difficult to obtain a good sealing.

To remedy these drawbacks, the present invention in its broadest sense relates to a measuring device consisting of a body defining an interior volume for receiving a liquid or powdered or pasty composition intended to be transferred to a container having a threaded neck, with said device having a skirt provided with a thread matching the thread of said container, and a membrane connected to the inner wall of said body by a peripheral zone having a generally annular shape characterized in that said peripheral zone has:

- at least one break-off line
- at least one area extending in a transverse plane, on the periphery of the membrane so configured as to cause the breaking of at least a part of said break-off line when it comes into contact with the front surface of the bottle neck.

This peripheral area advantageously has the same or a greater thickness than that of the membrane, so as to prevent an uncontrolled tearing. When screwing, tearing does not occur on a peripheral area having a low thickness, but along a break-off line formed on the peripheral area.

Thus, when the rotation is started after both threads are engaged, the device engages around the bottle neck, and the transversal area gets closer to the front surface of the neck until the front region of the neck comes into contact with the annular peripheral region—not with the membrane. When screwing on, the front surface of the neck exerts an axial stress, perpendicular to this cross-sectional area of increasing magnitude, until it causes the tearing along the break-off line, which releases the membrane.

Advantageously, the device comprises a specifically arc-shaped stop, the median line of which has a radius R, where R substantially corresponds to the median radius of the threaded neck of said container, with said stop being so configured as to rest on the front surface of the bottle neck upon screwing the skirt onto the threaded neck of the container and a hinge region the median radius of which is greater than R.

"When screwing" means, in this patent, a phase of screwing engagement:

subsequent to the initiation of screwing, where the two threaded elements come into contact, and prior to being stopped.

This device is a single-block piece, molded in one piece without any insert (possibly except the bottom placed after filling the device). This makes it possible to solve the sealing problems encountered when assembling additional parts.

This single-block device is closed either by an attached bottom, or by a deformation of the part opposite the membrane, for sealing, rolling or closing the filling end by any known method.

The opening of the device is ensured by the striking of the membrane when the stop comes in contact with the front surface of the bottle neck. When screwing on, the protrusion exerts a mechanical force onto the membrane causing the tearing of the break-off line and the tilting of the membrane towards the interior volume of the body, which enables the contents to flow.

Such part is also designed to be easily produced in a simple plastic injection mold, and does not require a sliding mold.

Advantageously, the stop is formed by a protrusion projecting relative to the outer surface of the membrane.

In a first alternative solution, said stop is located on the side diametrically opposite the middle of said break-off line.

In a second alternative solution, said stop is in the middle of said break-off line.

According to a particular embodiment, said break-off line extends over an arc of circle of less than 360-A°, with A ranging from 5 to 180°.

According to a particular exemplary embodiment, said break-off line 12 extends over an arc of a circle of less than 360-A°, with A ranging from 5 to 180° and said stop is oriented in the direction opposite the interior volume, with the center line of said protrusion having a radius R, where R substantially corresponds to the median radius of the threaded neck of said container, with said protrusion 22 being on an arc of A°.

Advantageously, said hinge area, the median radius of which is greater than R, extends over an arc of at least A°.

According to an alternative solution, the membrane is extended at its lower part by a striker extending perpendicularly to the surface of the membrane.

BRIEF DESCRIPTION OF THE DRAWINGS

The present invention will be best understood when reading the following detailed description thereof, which relates to a non-restrictive exemplary embodiment, while referring to the appended drawings, wherein.

DETAILED DESCRIPTION

Figure 1:
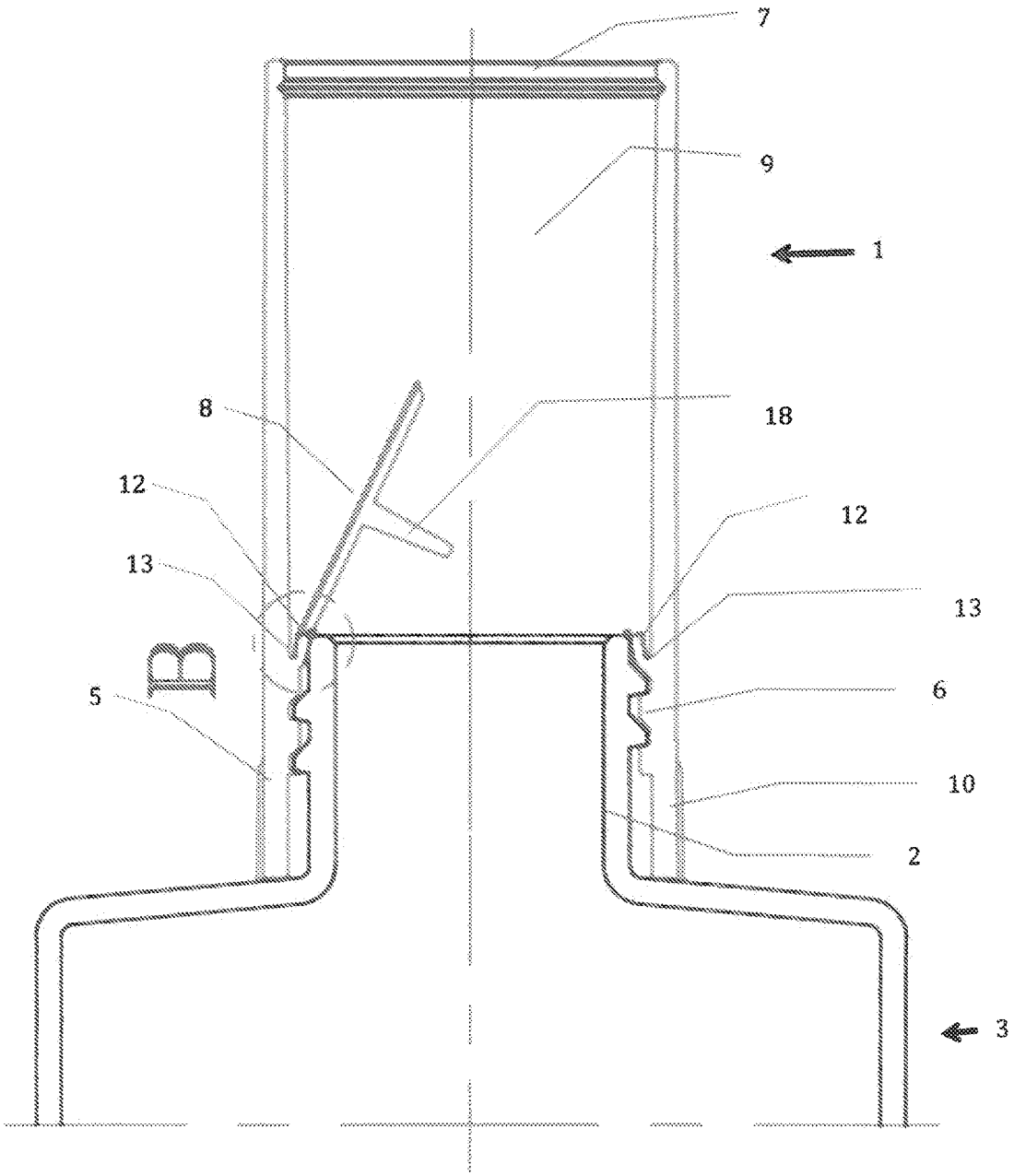
FIG. 1 shows a sectional view of a first example of a device according to the invention, as well as a portion of a bottle.
Figure 2A:
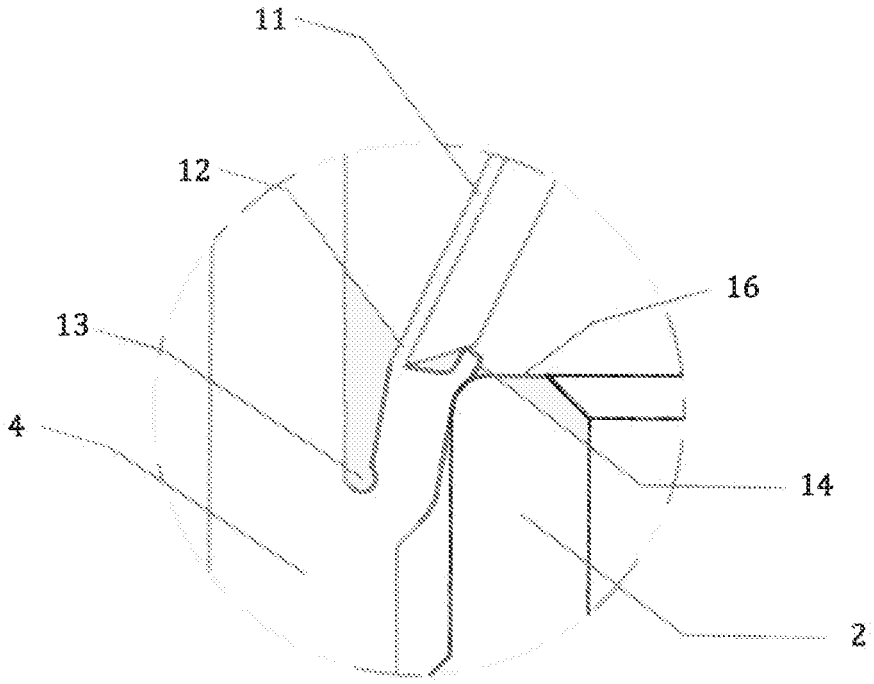
FIGS. 2A and 2B respectively show a detailed sectional view and a top view of the membrane.
Figure 2B:
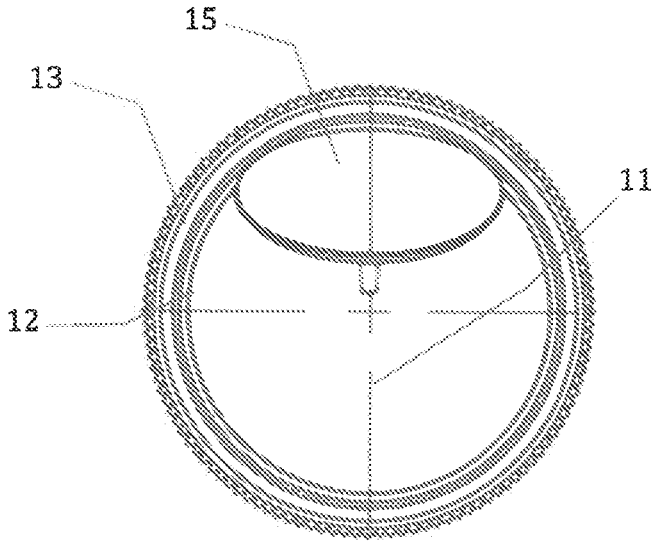

FIGS. 1, 2A and 2B illustrate a first exemplary embodiment.

The measuring device 1 is intended to be screwed onto the neck 2 of a bottle 3.

The neck 2 has, in a known or even a standardized manner, an external thread, specifically of a standard "28" diameter according to the standards commonly used, such as GMP, MCA, ALCOA, 1716 LEIGHT-WEIGH standards. Such arrangements may also be used for different diameters, such as "32" "38" "40" or other diameters, depending on the type of the container.

The measuring device 1 is manufactured by injection-molding of a plastic, preferably flexible, material such as polyethylene or polypropylene.

The measuring device 1 consists of a cylindrical body 4 forming, at the lower part thereof, a tubular skirt 5 having on its inner surface a thread 6 matching the thread 16 of the bottle neck 2. In the example described, the thread of the neck 2 is provided on the outer surface of the neck.

The skirt 5 has ridges 10 facilitating the exercise of a rotational torque on its outer surface.

The upper end of such cylindrical body 4 is closed by a clipped, welded or glued bottom 7.

At the other end, the cylindrical body 4 is closed by a punchable membrane 8.

The height of the skirt 5 is, in the example described, so configured as to abut against the shoulder of the bottle or of the neck thereof, when the maximum tightening is achieved. This solution makes it possible to limit the screwing stroke and to prevent excessive sinking of the neck into the body 4.

Between these two closed ends, the cylindrical body 4 defines a useful volume 9 totally available to receive a liquid, pasty or powdered content.

The membrane 8 has a central disk region 11 surrounded by an annular peripheral zone a portion 13 of which is thinned to form a hinge. The thinned part 13 forming a hinge extends between the body 4 and the break-off line 12. This peripheral zone 13 is not intended to be torn, but to deform to switch from an initial transverse position to a conical position directed toward the bottom of the device, after tearing of the break-off line 12. It then forms a conical sealing lip matching the upper part of the neck, to the sealing surface thereof, without coming in contact with the thread.

The radius of this annular peripheral zone 13 is slightly greater than the outer radius of the bottle neck 2, and smaller than the inner radius of the cylindrical body 4. The membrane has a break-off line 12 having a radius smaller than the radius of the hinge zone 13. The radius of the rupture zone 12 is also preferably smaller than or equal to the median radius of the bottle neck. In any event, the front surface of the neck does not bear on the membrane formed within the break-off line 12, so as to preserve the tightness of the connection zone between the device and the bottle neck.

This sealing is provided by folding the peripheral zone 13 forming a conical sealing lip.

The radius of the membrane 8 is at least partially smaller than or equal to the median radius of the front surface of the neck 2 of the matching bottle.

In the example described, the membrane 8 has, at the hinge area 13, a spout 14 extending below a segment of the break-off line 12, so as to avoid the tearing at the point where the membrane comes into contact, during screwing, with the front surface of the neck 2 of the bottle. Prior to screwing, the spout 14 has a tubular shape, perpendicular to the membrane.

After screwing, the spout 14 deforms to take a conical or annular shape, and comes to be circularly supported by the upper edge of the bottle neck.

Therefore, when screwing goes on, the curved spout 14 prevents tearing at this point, and creates a leverage effect transmitting the stresses to the opposite part of the membrane. Tearing then occurs along the break-off line 12, at a location diametrically opposite the portion having the curved spout 14.

To improve this leverage effect, the membrane has a thickened portion 15 which prevents the elastic deformation of the central region 10 and ensures a good transfer of forces, close to the spout 14.

The operation is as follows:

The measuring cap 1 is engaged onto the neck 2 of the bottle 3. Screwing is then executed in a known manner until the annular peripheral area between the hinge 13 and the break-off line 12 and surrounding the membrane 10 comes into contact with the front surface 16 of the neck 2 of the bottle 3. Due to the helical shape of the thread, the contact begins at a particular angular point where the spout is located 14.

According to a non-restrictive alternative solution, the presence of this spout 14 locally protecting the break-off line 12 results in the mechanical stress exerted perpendicularly to the surface of the membrane 8 forcing the disc central zone 10 of the membrane to tilt, which transmits the forces, especially because of the reinforced region 15, toward the diametrically opposite part. These stresses then cause the tearing of the break-off line substantially on the side opposite the spout 14. When screwing on, deformation of the cap 8 is increased which rapidly becomes significantly angled relative to the transverse plane.

In this exemplary embodiment, the disc region 10 of the membrane 8 is extended further at its lower surface by a striker 18 erected in a direction, at rest, perpendicular to the transverse plane. This striker punches the membrane made of aluminum (or another material) that may close off some bottles to enable the contents of the measuring device to flow into the container. The measuring device can thus be used without any handling of the bottle other than the engagement and screwing onto the neck of the bottle.

FIG. 2*a* describes in detail the hinge and tightness after screwing and tearing of the rupture zone.

The peripheral annular region 13 forming a hinge has been pushed to switch from an initial transverse position to a conical position, bearing against the upper tubular surface of the neck 2. The spout 14 has also been deformed to abut against the sealing surface (or the outer upper edge) of the neck 2, ahead of the thread. These two parts 13 and 14 thus seal the connection between the measuring device and the bottle neck.

The deformation of the annular area 13 is facilitated on the one hand by the thinned but not tearable annular zone forming a hinge, and the—optionally thicker—extension thereof located within the break-off line.

FIG. 2B shows a bottom view of the device.

When the plastic material is sufficiently deformable, the annular peripheral zone directly extends from the surface of the body to the break-off line.

If the material is more rigid, a zone of reduced thickness forming a hinge is provided.

Figure 3:
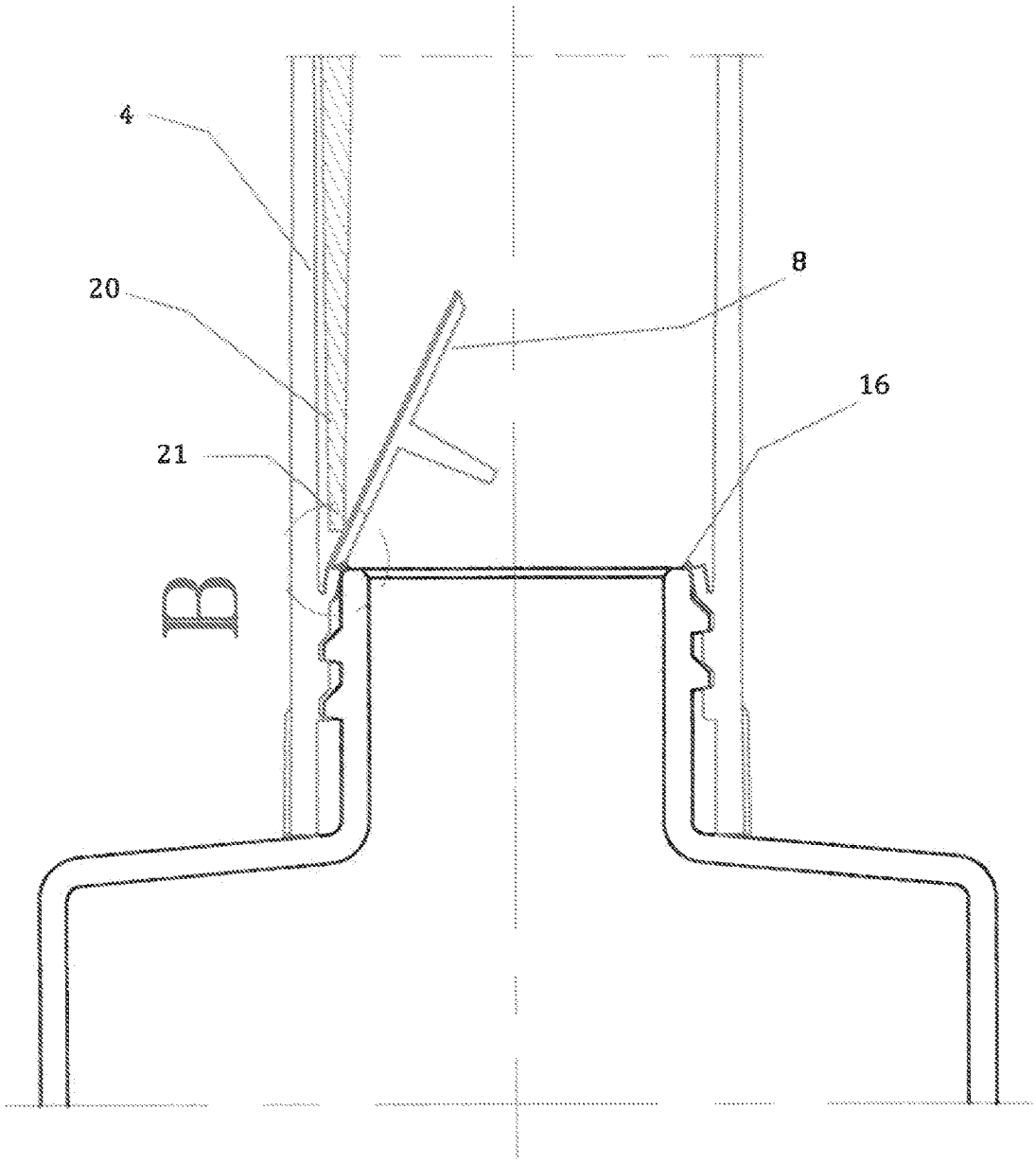
FIG. 3 and FIG. 4 show sectional views of a second exemplary embodiment, respectively in an intermediate screwing position and complete screwing position.
Figure 4:
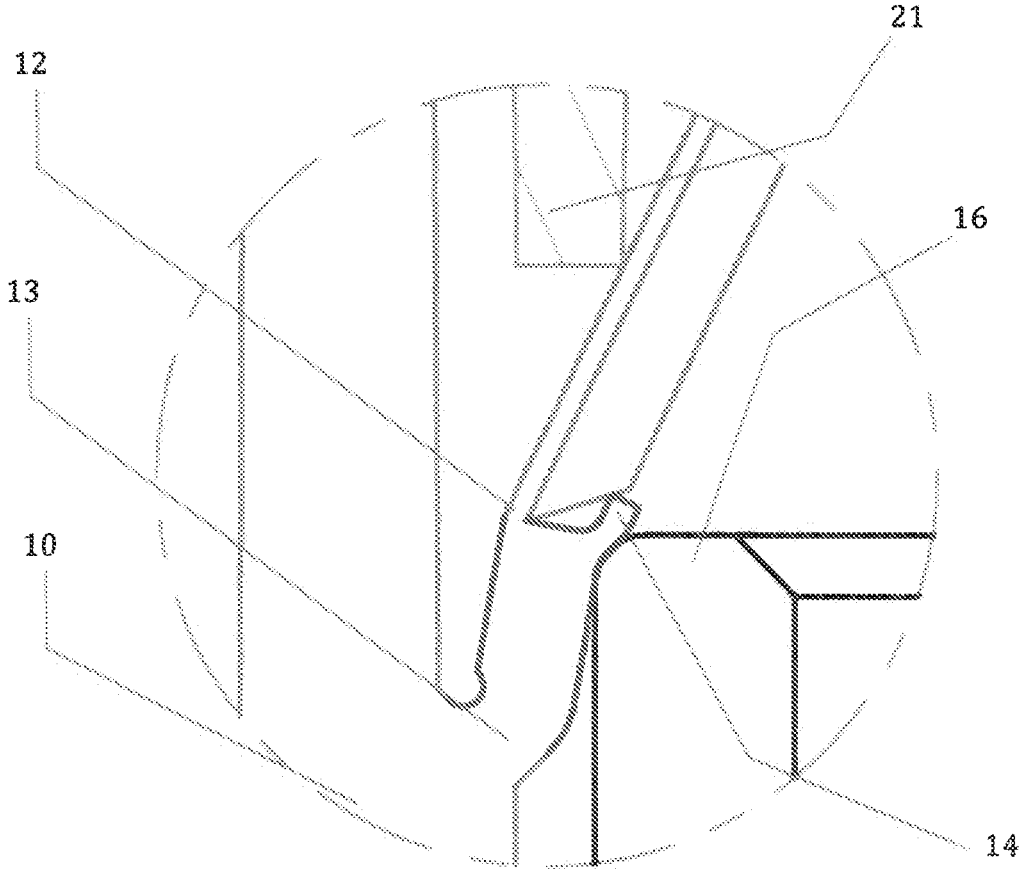

FIGS. 3 and 4 shows an alternative embodiment, where the body 4 of the measuring device 1 has, in an eccentric area a protruding index 20 the lower end 21 of which comes into contact with the edge of the membrane 8 when screwing causes the contacting of the front surface 16 of the bottle neck with the spout 14 provided at the lower surface of the membrane.

Such index 20 participates in preventing the untimely tearing of the break-off line 12 and ensuring the transmission of mechanical forces to the opposite side of the membrane, where breaking is to occur.

Figure 5:
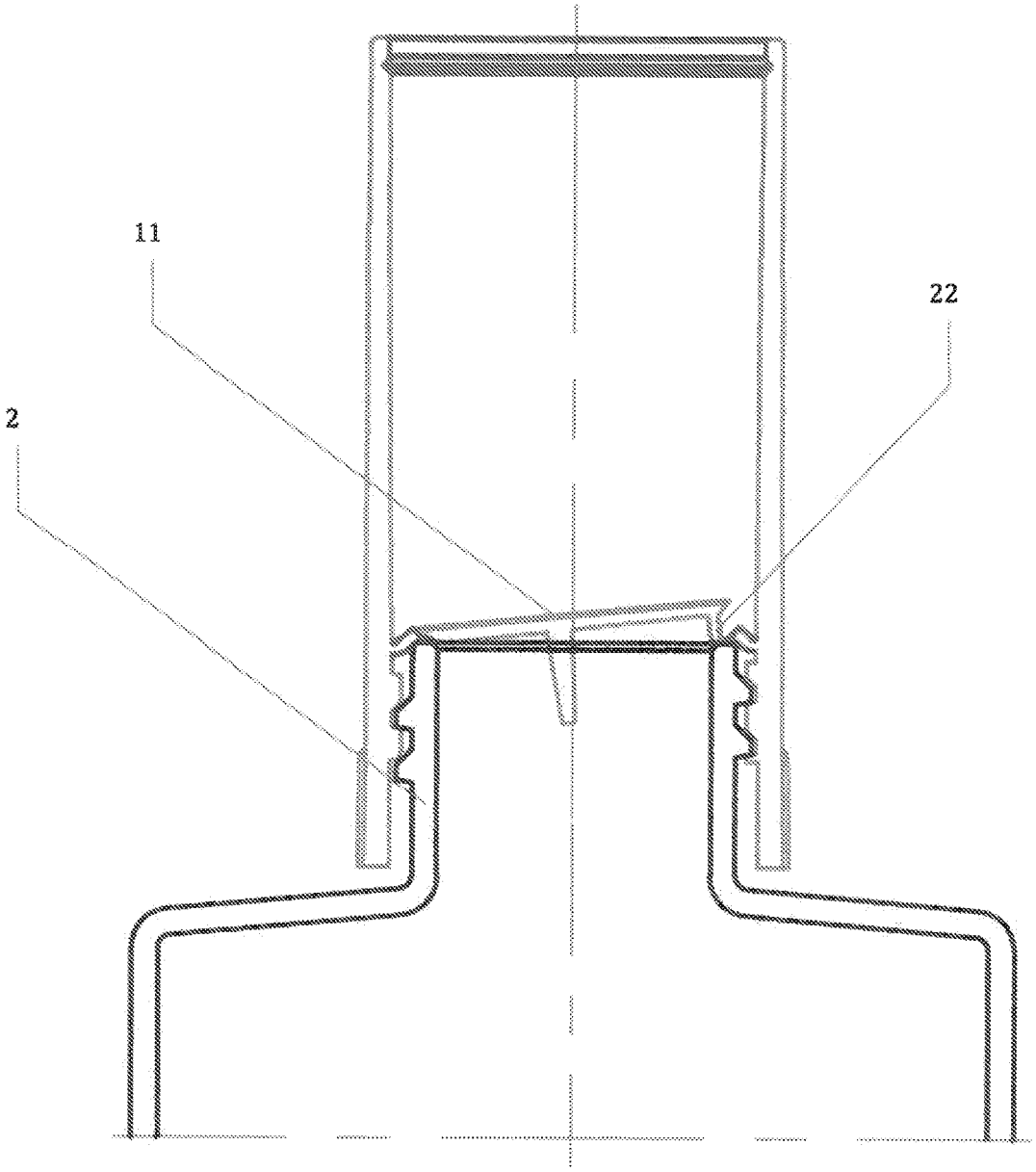
FIG. 5 and FIG. 6 show sectional views of a third exemplary embodiment, respectively in an intermediate screwing position and complete screwing position.
Figure 6:
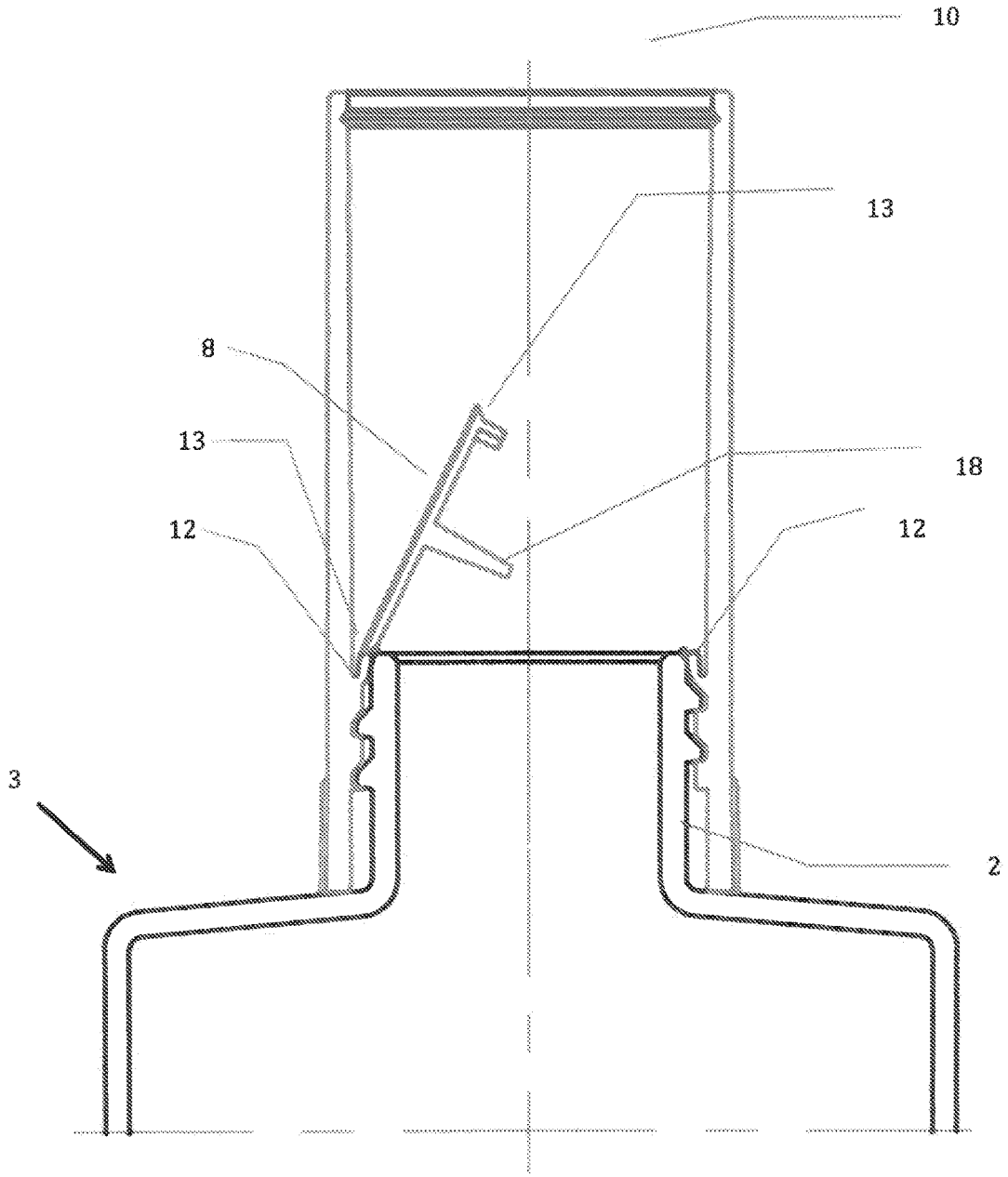

FIGS. 4 and 5 show another alternative embodiment wherein the membrane 8 has a protrusion extending over the lower peripheral surface of the membrane at a radial distance smaller than the radius of the break-off line 12 and the radius of the hinge 13. The radial distance from the protrusion 22 substantially corresponds to the median radius of the front surface 16 of the neck 2 of the bottle 3.

Figure 7:
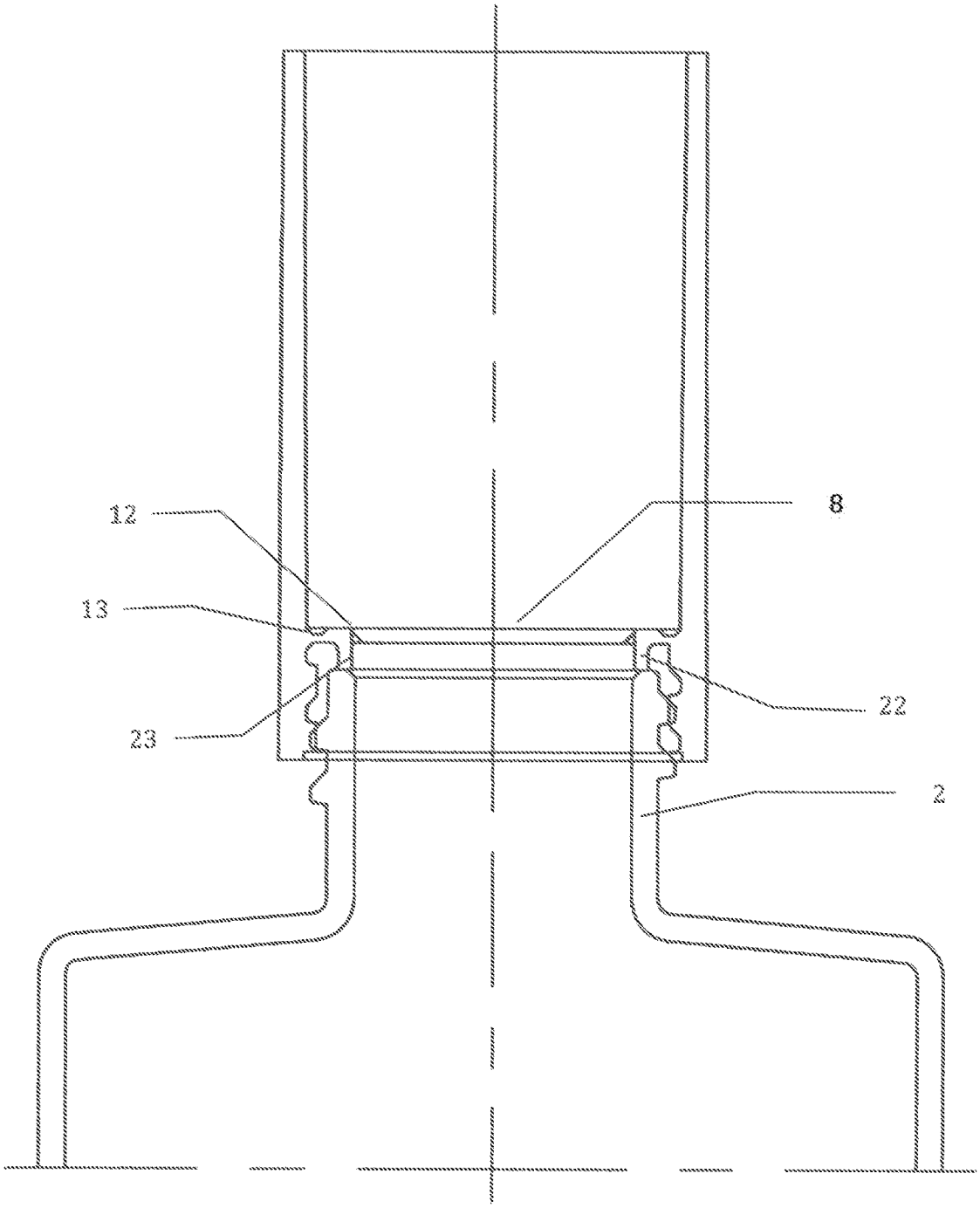
FIG. 7 and FIG. 8 show sectional views of a fourth exemplary embodiment, respectively in an intermediate screwing position and complete screwing position.
Figure 8:
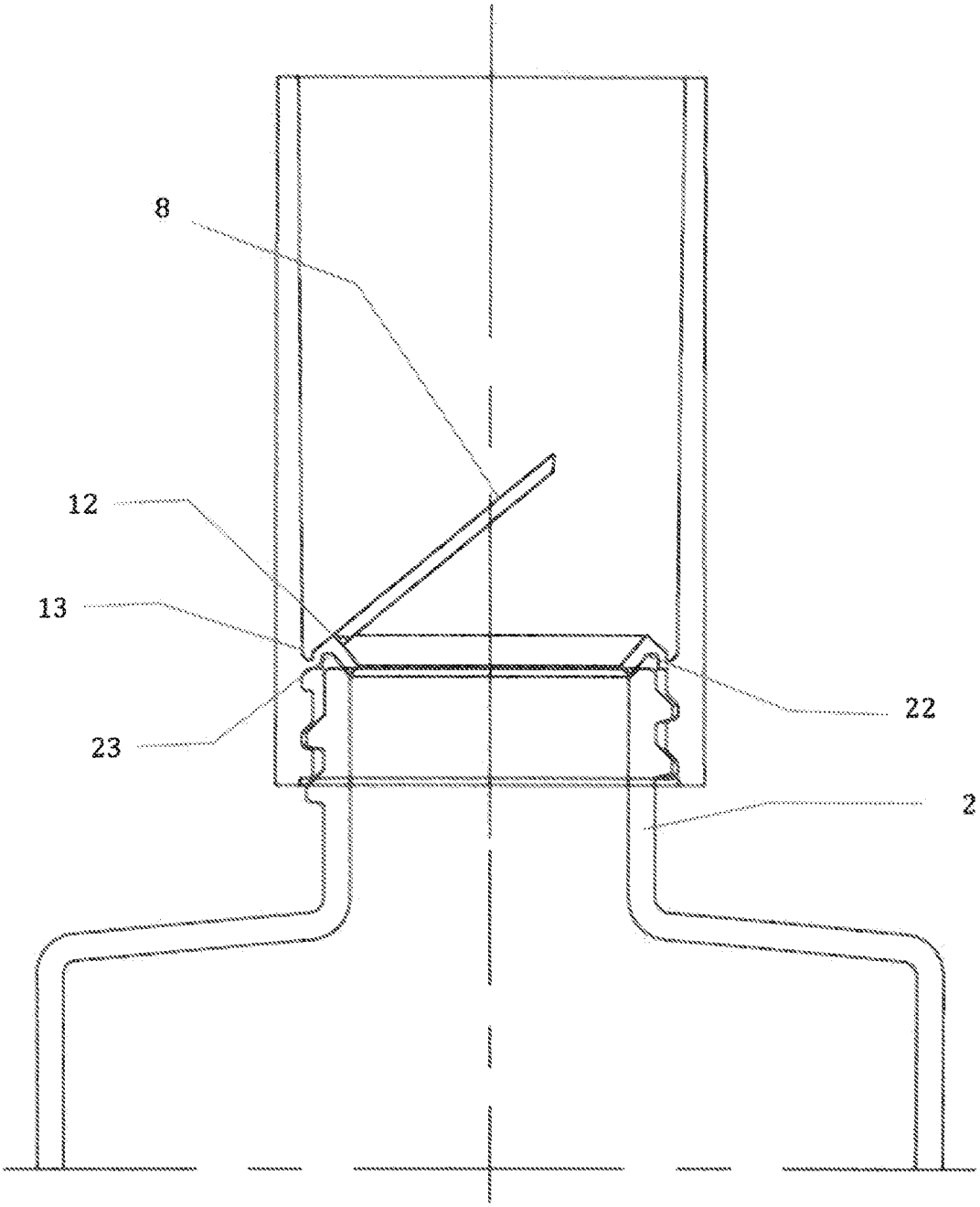

FIGS. 7 and 8 show another alternative embodiment, wherein the membrane 8 has a plurality of protrusions 22, 23 spaced apart circumferentially. The first one 22 of these protrusions which comes into contact with the front face 16 of the neck of the bottle transmits the mechanical forces that cause the tearing along the diametrically opposite break-off zone.

Figure 9:
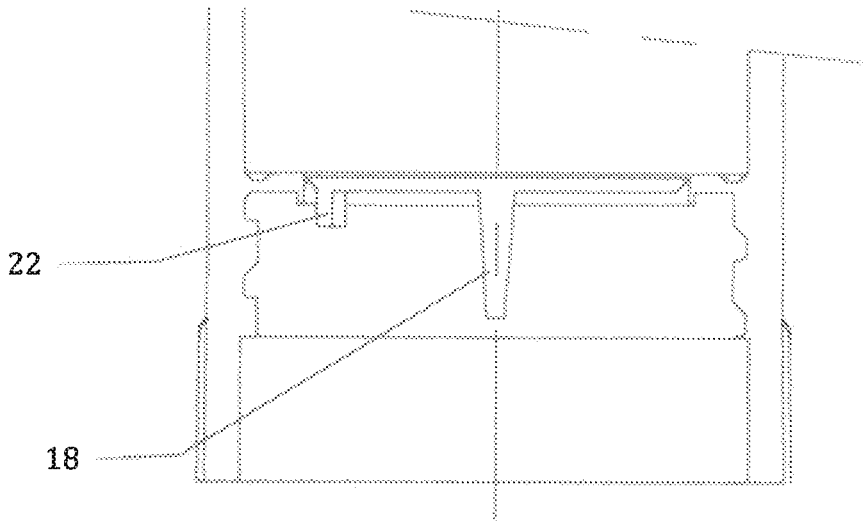
FIGS. 9 and 9A respectively show a cross-sectional view and a bottom view of a striking pin.
Figure 9A:
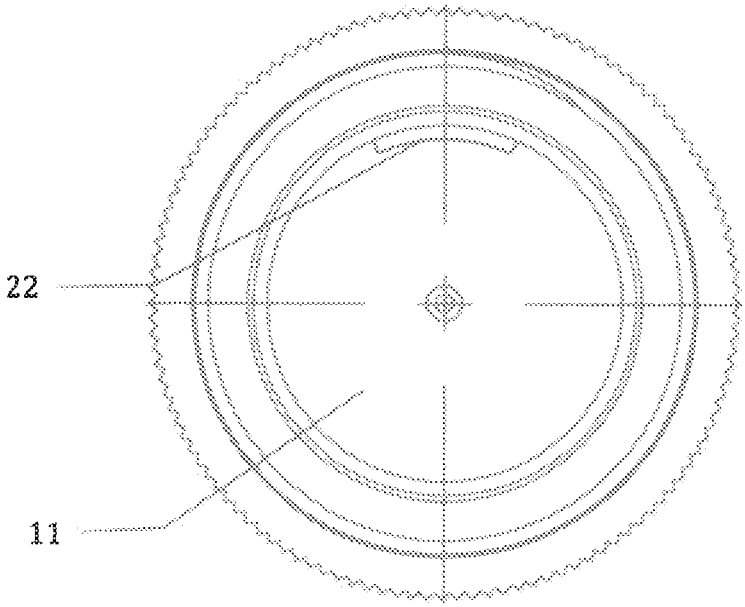

FIGS. 9 and 9A show detailed views of the membrane and more particularly the striking pin consisting, in this example in a striking pin 22 having an arcuate shape extending over approximately 30°, with a width substantially corresponding to the thickness of the front surface 16 of the bottle neck and a height substantially corresponding to the thread pitch.

Figure 10:
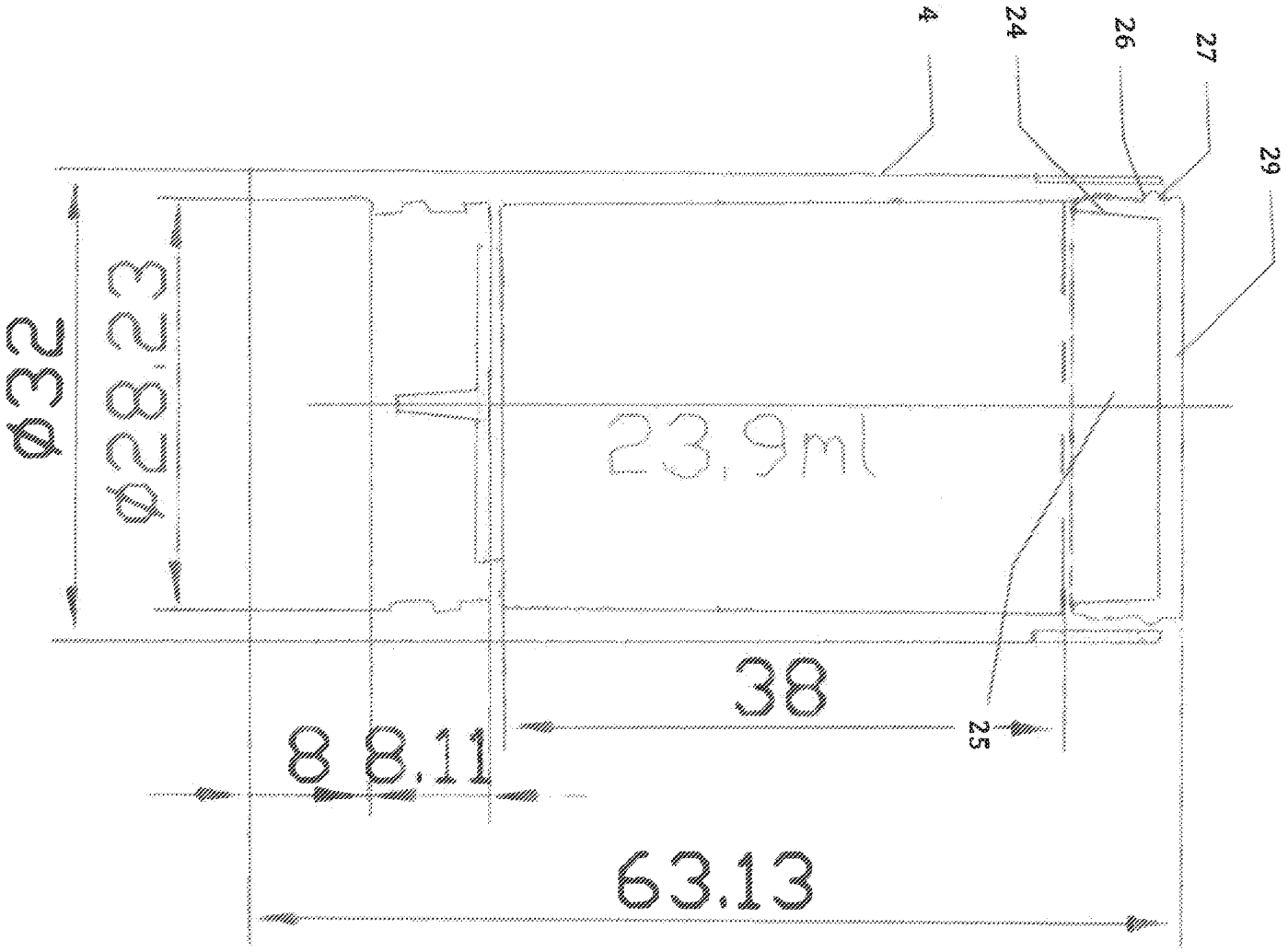
FIGS. 10 and 11 respectively show a sectional view of a measuring cap according to the invention and a detailed view of the connection of the body of the measuring device with the bottom.
Figure 11:
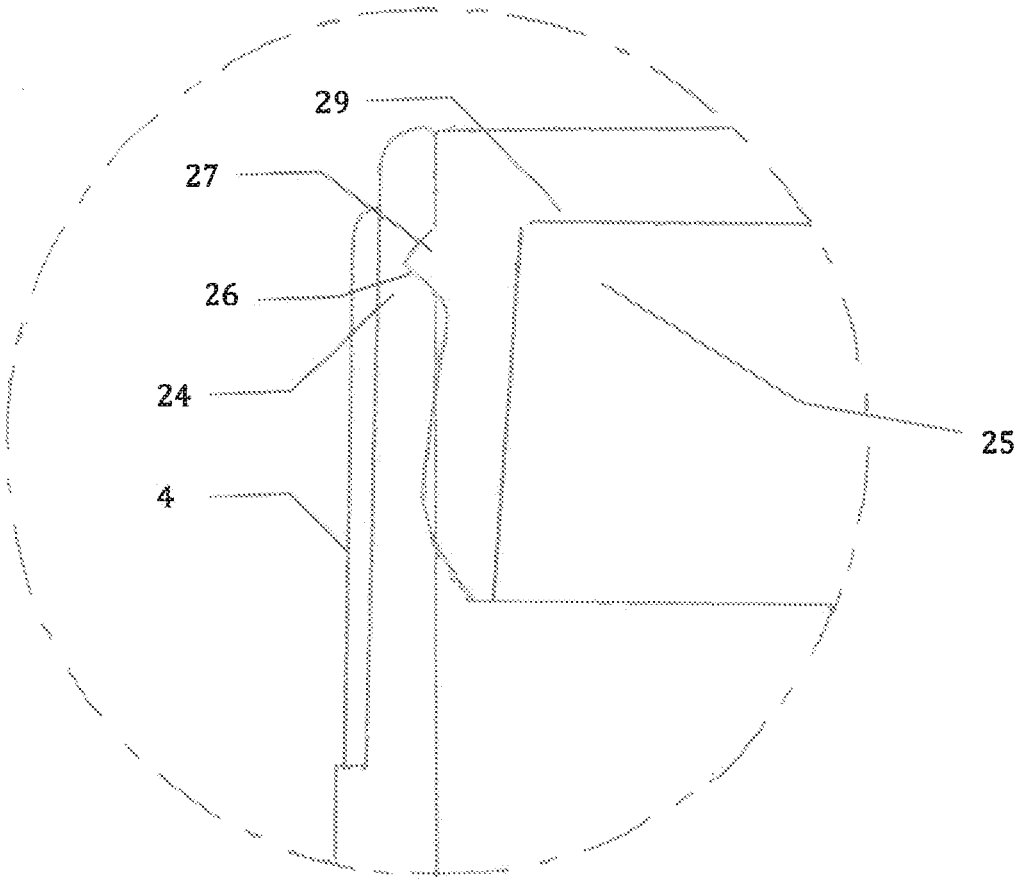

FIGS. 10 and 11 respectively show a sectional view of a measuring cap according to the invention, and a detailed view of the connection of the measuring device body with the bottom 25.

Such bottom has a transverse disc portion 29 extended by a tubular skirt 28 the external diameter of which corresponds to the internal diameter of the tubular body 4. Such skirt 28 has an annular shoulder 26 being engaged by force into an annular groove 27 provided at the inner surface of the body 4.

The invention claimed is:

1. A cap comprising a body defining an interior volume for receiving a liquid or powdered or pasty composition intended to be transferred to a container having a threaded neck, with said device having a skirt provided with a thread matching the thread of the neck of said container, and a membrane connected to the inner wall of said body by a peripheral zone having a generally annular shape, wherein said membrane has a disk-shaped central zone surrounded by an annular peripheral zone, a portion of said annular peripheral zone forms a hinge extending between the body and a break-off line, with such annular peripheral zone being so configured as to bear on the upper surface of the neck of the bottle during the screwing of the skirt onto the threaded neck of the bottle and to cause at least a partial rupture of said break-off line, with a cylindrical body thus defining a useful volume available to receive a liquid, pasty or powdered content.

2. The cap according to claim 1, wherein said annular peripheral zone has a spout having an initial tubular shape, close to the break-off line, and in that said peripheral zone and said spout are deformed after screwing to form tapered lips bearing against the surface of the bottle neck.

3. The cap according to claim 1, wherein said annular peripheral zone has a hinge zone a median radius of which is greater than R, with R corresponding to an inner radius of the neck of the bottle.

4. The cap according to claim 3, wherein said annular zone configured to bear against the front face of the bottle neck is formed by at least one stop a median line of which has a radius R, where R substantially corresponds to the median radius of the threaded neck of said container.

5. The cap according to claim 4, wherein said stop is located on a side diametrically opposite the middle of said break-off line.

6. The cap according to claim 4, wherein said stop is located in the middle of said break-off line.

7. The cap according to claim 4, wherein said break-off line extends over an arc of a circle of less than 360-A°, with A ranging from 5 to 180° and in that said stop is oriented in the direction opposite the interior volume, with a center line of said protrusion having a radius R where R substantially corresponds to the median radius of the threaded neck of said container, with said protrusion extending over an arc of A°.

8. The cap according to claim 7, wherein said hinge area, the median radius of which is greater than R, extends over an arc of at least A°.

9. The cap according to claim 1, wherein said break-off line extends over an arc of circle of less than 360-A°, with A ranging from 5 to 180°.

10. The cap according to claim 1, wherein the membrane is extended at its lower part by a striker extending perpendicularly to the surface of the membrane.

* * * * *